US009615991B2

(12) United States Patent
Logan et al.

(10) Patent No.: US 9,615,991 B2
(45) Date of Patent: Apr. 11, 2017

(54) INTERMITTENT PNEUMATIC COMPRESSION DEVICE

(71) Applicants: Kerry Logan, Lafayette, IN (US); Kathryn Logan, Lafayette, IN (US)

(72) Inventors: Kerry Logan, Lafayette, IN (US); Kathryn Logan, Lafayette, IN (US)

( * ) Notice: Subject to any disclaimer, the term of this patent is extended or adjusted under 35 U.S.C. 154(b) by 566 days.

(21) Appl. No.: 14/035,382

(22) Filed: Sep. 24, 2013

(65) Prior Publication Data

US 2014/0088476 A1 Mar. 27, 2014

Related U.S. Application Data

(63) Continuation of application No. PCT/US2012/030086, filed on Mar. 22, 2012.

(60) Provisional application No. 61/467,692, filed on Mar. 25, 2011.

(51) Int. Cl.
*A61H 9/00* (2006.01)

(52) U.S. Cl.
CPC ..... *A61H 9/0007* (2013.01); *A61H 9/0078* (2013.01); *A61H 2201/5005* (2013.01); *A61H 2201/5033* (2013.01); *A61H 2201/5038* (2013.01); *A61H 2201/5097* (2013.01); *A61H 2209/00* (2013.01)

(58) Field of Classification Search
CPC ..... A61H 9/00; A61H 9/005; A61H 9/0078; A61H 9/0085; A61H 9/0092; A61H 2201/0103; A61H 2201/1238
See application file for complete search history.

(56) References Cited

U.S. PATENT DOCUMENTS 2,113,253 A * 4/1938 Gray ..... A61H 9/005 128/DIG. 20
2,896,612 A * 7/1959 Bates ..... A61H 9/0078 297/DIG. 3
3,391,692 A * 7/1968 Spielberg ..... A61H 9/0078 601/152
3,403,673 A * 10/1968 MacLeod ..... A61F 5/34 600/16

(Continued)

OTHER PUBLICATIONS

International Search Report and Written Opinion issued on Nov. 1, 2012 in the PCT application No. PCT/US2012/030086.

*Primary Examiner* — Justine Yu
*Assistant Examiner* — Michael Tsai
(74) *Attorney, Agent, or Firm* — Woodard, Emhardt, Moriarty, McNett & Henry LLP

(57) ABSTRACT

Intermittent pneumatic compression (IPC) devices facilitate fluid circulation in a body by providing alternating higher pressure and a lower or no pressure in an associated inflatable cuff. A source of air at a pressure less than 130% of the higher pressure at the inflatable cuff communicates to the inflatable cuff through a large-cross-section, continuously-open passageway. A large vent valve on that passageway opens for a lower or no pressure condition and closes to achieve a higher pressure within 0.1 second. For the lower or no pressure state, the vent valve not only vents the inflatable cuff, but also vents continuing air flow from the source of air pressure, until the next rapid pressure rise. The periods between successive compressions are from 2 to 10 seconds, with compressions from 0.35 to 5 seconds. While most of the inflatable cuff is not transparent, portions adjacent the heel and toes are.

24 Claims, 7 Drawing Sheets

(56) References Cited

U.S. PATENT DOCUMENTS

| | | | | | |
|---|---|---|---|---|---|
| 3,760,801 | A * | 9/1973 | Borgeas | A61H 1/02 | 601/148 |
| 3,896,794 | A * | 7/1975 | McGrath | A61H 9/0078 | 601/152 |
| 3,942,518 | A * | 3/1976 | Tenteris | A61H 9/0078 | 128/DIG. 10 |
| 4,086,920 | A * | 5/1978 | Miniere | A61H 9/0078 | 601/150 |
| 4,186,732 | A * | 2/1980 | Christoffel | A61H 9/0078 | 601/150 |
| 4,374,518 | A * | 2/1983 | Villanueva | A61H 9/0078 | 601/152 |
| 4,989,589 | A * | 2/1991 | Pekanmaki | A61H 9/0078 | 601/150 |
| 5,109,832 | A | 5/1992 | Proctor et al. | | |
| 5,218,954 | A | 6/1993 | Van Bemmelen | | |
| 5,370,603 | A * | 12/1994 | Newman | A61H 9/0078 | 601/150 |
| 5,676,639 | A * | 10/1997 | Schild | A61G 7/05776 | 601/148 |
| 6,905,456 | B1 | 6/2005 | Brunner et al. | | |
| 7,597,670 | B2 * | 10/2009 | Warwick | A61H 9/0078 | 601/152 |
| 7,618,382 | B2 | 11/2009 | Vogel et al. | | |
| 2004/0260218 | A1 * | 12/2004 | Shah | A61H 9/0078 | 601/152 |
| 2009/0177184 | A1 * | 7/2009 | Christensen | A61H 9/0057 | 604/506 |
| 2009/0204037 | A1 * | 8/2009 | Ravikumar | A61H 9/0092 | 601/152 |
| 2010/0036299 | A1 | 2/2010 | Gough | | |

* cited by examiner

INTERMITTENT PNEUMATIC COMPRESSION DEVICE

CROSS-REFERENCE TO RELATED APPLICATION

This application is a continuation of International Patent Application No. PCT/US2012/030086, filed Mar. 22, 2012 which claims the benefit of U.S. Provisional Application No. 61/467,692 filed on Mar. 25, 2011 which is hereby incorporated by reference.

TECHNICAL FIELD OF THE DISCLOSURE

Embodiments of the present invention generally relate to devices for repeatedly compressing a part of a body in a manner that is safe and improves circulation. The technology of the present invention can be applied to numerous medical conditions that involve impaired circulation, most frequently associated with the arms and legs, and often with feet or hands. Examples of such medical conditions include but are not limited to peripheral arterial disease (PAD), venous insufficiency, prevention of deep vein thrombosis (DVT), lymphedema, as well as sports injuries, and other conditions where improving circulation promotes the healing process. Apart from medical conditions, the present invention can also be used generally for massage to make a person feel better, and feel refreshed. Embodiments of the present invention specifically relate to such devices which can produce rapid compression/decompression of the concerned body region or regions in frequent, short duty cycles that promote healing without causing undue pain to the patient.

BACKGROUND

Peripheral vascular disease (PVD) is a slow and progressive circulation disorder. It may involve disease in any of the blood vessels outside of the heart and diseases of the lymph vessels—the arteries, veins, or lymphatic vessels. Organs supplied by these vessels such as the brain, heart, and legs, may not receive adequate blood flow for ordinary function. However, the legs and feet are most commonly affected, thus the name peripheral vascular disease. Conditions associated with PVD that affect the veins include deep vein thrombosis (DVT), varicose veins, and chronic venous insufficiency. Lymphedema is an example of PVD that affects the lymphatic vessels. When PVD occurs in the arteries outside the heart, it may be referred to as peripheral arterial disease (PAD).

There are about 8 million Americans that suffer from PAD. PAD is caused by restriction in arterial flow to the limbs and results in pain when the body can't get needed resources. The largest group of the overall population to get PAD is older, likely diabetic and often with other complicated health issues. The non-amputation surgical solution is often an arterial graft, which has surgical and recovery complications. For this large group a good non-invasive alternative is an Intermittent Pneumatic Compression (IPC) device. An IPC device basically works like a large milking machine, intermittently squeezing on the limb to help circulation. There are several physiologies that occur. The rapidness of the compression simulates muscle contraction like exercise. This creates a chemical response in the limb that tends to develop vascular pathways that ideally can have positive long-term effects. The actual compression tends to empty out the blood in the veins. This reduces venous pressure encouraging arterial blood to empty and return faster. There is also an effect on the lymphatic system as it may enhance draining lymphatic fluid through tissue and nodes to the veins. IPC devices can also enhance wound healing.

The severe condition of PAD is critical limb ischemia (CLI), which affects an estimated 1.1 million Americans and occurs when arterial circulation is so bad it can cause ulcers in the limbs. After 6 months of reaching the CLI stage the mortality rate is 20%. According to The Sage Group, 160,000 PAD related amputations per year are performed in the US. In 60-70% of the CLI amputees, amputation was the first procedure to be performed. Even after surviving the first amputation, the mortality rate is 40% after just 2 years. A second amputation follows 30% of the time with full mobility only being restored 50% of the time. These figures do not consider persons suffering from venous ulcers or lymphedema (swelling) and countries outside the United States, or that the senior citizen population is growing faster than the general population.

IPC devices come in many forms. One type is a small and portable home IPC device that provides limited capacity but is effective on swelling in limited areas, and on less severe CLI cases, provide some wound healing. An example of such a device is the ArtAssist® Device marketed by ACI Medical, LLC of San Marcos, Calif. Another example type is a clinical IPC device which Mayo Clinic uses that costs a great deal more and requires a large amount of space and equipment. This device is the Circulator Boot™ marketed by Circulator Boot Company, LLC, Westerville, Ohio. While perhaps not practical or feasible for home use, this device is somewhat more effective on swelling over larger areas, has greater capacity and longer-term benefit, and can be effective on severe CLI cases encountered in the hospital setting. Both of these types of IPC devices provide only relatively short-term health effects. Once the ulcer is healed, the limb is saved until the next ulcer develops.

Another circulatory condition is Lymphedema. Lymphedema, also known as lymphatic obstruction, is a condition of localized fluid retention and tissue swelling caused by a blockage in the lymphatic system, an important part of the body's immune and circulatory systems. The blockage prevents lymph fluid from draining well, and as the fluid builds up, the swelling continues. Lymphedema is most commonly caused by the removal of or damage to lymph nodes as a part of cancer treatment.

SUMMARY

The claims, and only the claims, define the invention. Thus, the invention comprises of all of the differences from the above described prior art that would not have been obvious to a person of ordinary skill in the art at the time we made our invention, and as are more particularly set forth in the claims. Merely by way of partial example, in certain aspects, the present invention provides unique intermittent pneumatic compression (IPC) devices for facilitating fluid circulation in a body by alternating between a higher pressure and a lower or no pressure in an associated inflatable cuff. In accordance with some forms of the invention, such IPC devices are configured to have a pressure source providing air at a pressure less than 130% of the higher pressure at the inflatable cuff. In some embodiments, a vent valve is coupled to a passageway communicating with the source of air pressure whereby the vent valve can be opened when a lower or no pressure condition in the inflatable cuff is desired, and can close when the higher pressure is desired.

In certain aspects, control is provided which may achieve rapid compressions of relatively small durations at more frequent rates than previous devices.

Further forms, objects, features, aspects, benefits, advantages, and embodiments of the present invention will become apparent from a detailed description and drawings provided herewith.

BRIEF DESCRIPTION OF THE PREFERRED EMBODIMENTS

Figure 1:
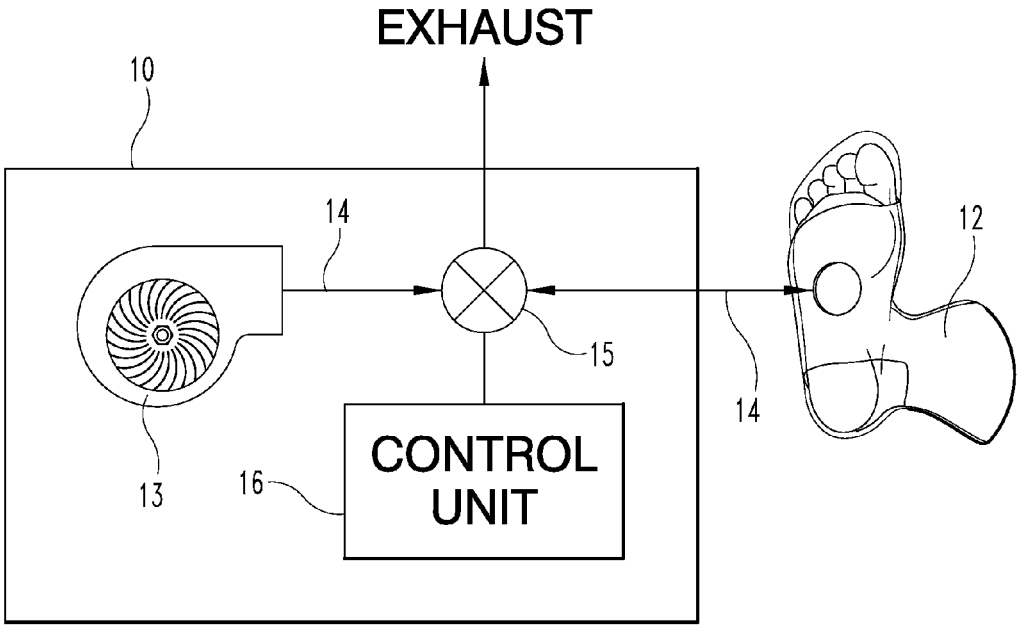
FIG. 1 is a functional block diagram depicting various components of an intermittent pneumatic compression (IPC) device.

For the purposes of promoting an understanding of certain principles of the invention, reference will now be made to the embodiments illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates. While the embodiments described below, for example, relate to intermittent pneumatic compression associated with circulatory dsyfunctions, for purposes of illustration, it will be appreciated that the principles of the present invention are also relevant to other applications such as for example treating sports injuries, massage, etc.

Referring now to the drawings, FIGS. 1-7 depict various illustrative embodiments. There is generally shown in diagrammatic form in FIG. 1 an intermittent pneumatic compression device 10 for facilitating fluid circulation in the body of the user/wearer. The device 10 generally includes an inflatable cuff 12, a source of low air pressure 13, a passageway 14 between the source of air pressure 13 and the inflatable cuff 12, a vent valve 15 coupled to the passageway 14, and a control means 16 to control air pressure to the inflatable cuff 12. The passageway 14 is preferably continuous through vent valve 15 and is preferably at least 30 cm. in length between the vent valve 15 and inflatable cuff 12. Preferably, passageway 14 is not impeded for that at least 30 cm. in length by any pressure regulator device, providing a large continuous path from the interior of the cuff to a relatively remote control device, which in this preferred embodiment, is vent valve. The device 10 operates by alternating between a higher pressure and a lower or no pressure in an associated inflatable cuff 12 with frequent, small duty cycles.

Figure 2:
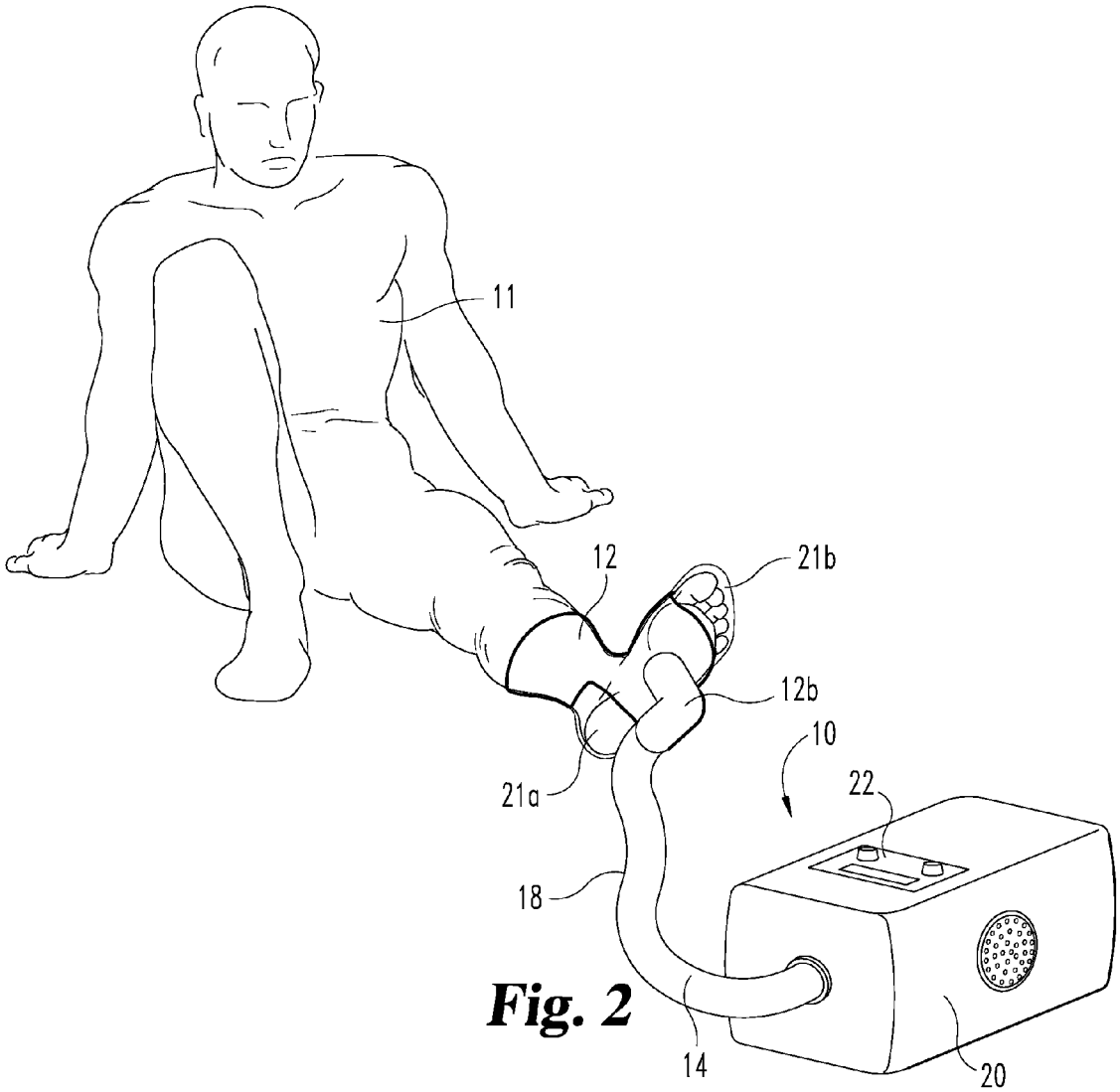
FIG. 2 is a perspective view showing an illustrative embodiment of an intermittent pneumatic compression device in accordance with FIG. 1 attached to the user/wearer.

FIG. 2 depicts an illustrative example of one form of the inflatable cuff 12 mounted on a user/wearer 11. The wearer 11 is depicted in a sitting, partially reclined position with the involved leg elevated to a substantially horizontal position. It is seen that the inflatable cuff 12 is formed to surround and cover the foot and calf regions of the involved leg of the wearer 11. The precise extent of the body regions in contact with the cuff 12 may vary depending upon the type of condition being addressed and the location of the affected body region. It should also be appreciated that many forms of conventional inflatable cuff designs may be readily adapted for use with the IPC device 10, and therefore more detailed aspects of the cuff design including but not limited to size, shape, materials, forms of attachments, etc., are therefore omitted for sake of clarity. While a calf and foot cuff is shown for illustration, other cuffs are envisioned to be equally suitable for other extremities as well, such as for a calf alone, a foot alone, thigh, arm, hand, finger or toe, for examples.

As shown, minor portions of the inflatable cuff 12 are see-through portions 21*a* and 21*b* permitting visibility of the wearer's toes and heel during operation of the device for enhanced safety considerations. See-through portions 21*a* and 21*b* may for example be formed of a 4 mm clear flexible plastic material. The inflatable cuff 12 shown is a single-chamber bladder design adapted to treat arterial flow insufficiencies. The device 10 may also be adapted to have a multi-chambered bladder for sequential inflation/deflation of the chambers such as may for example be desired to treat venous or lymphatic conditions.

Figure 2A:
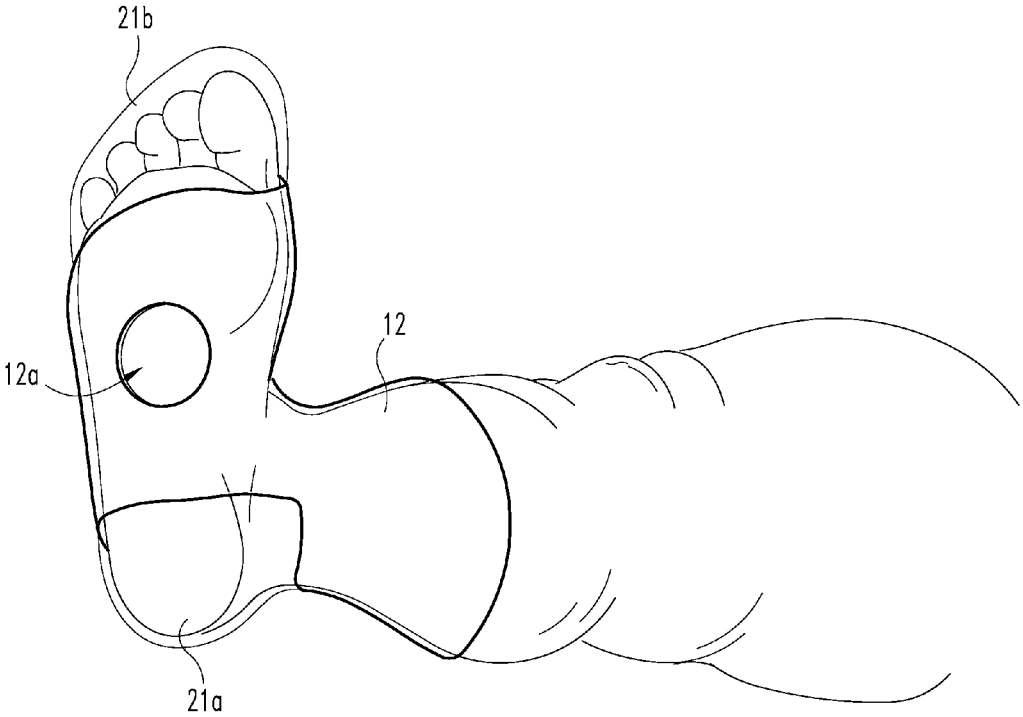
FIG. 2*a* is a perspective view showing the underside foot portion of the inflatable cuff attached to the user/wearer.

Extending from the bottom of the cuff 12 on the underside of the wearer's foot is a 1.5 inch diameter flexible hose 18 forming the passageway 14 that communicates between the cuff 12 and low air pressure source 13 of FIG. 1 contained within housing or console 20. As seen in FIG. 2*a*, the inflatable cuff 12 is provided with an inlet port 12*a*. The inlet port 12*a* attaches to an L-shaped swivel coupling 12*b* which connects to flexible hose 18. Alternatively to the underside of the foot, other points of attachment of hose 18 may be chosen if desired. The console 20 is preferably designed to be portable for home use, although larger professional and clinical versions are also contemplated. In addition to the low air pressure source 13, the console 20 also houses the vent valve 15 and control unit 16 assemblies as will be described later herein. Suitable operator controls (e.g., power switch, pressure selector control), indicators, gauges, and/or other operator information and controls are conveniently provided on a panel 22 at the top of console 20. Alternatively, if designed as a home use device for a specific application such as for example arterial ischemia, it will avoid operator error to provide only an on/off power switch and thus require no control changes/adjustments on the part of the home user. While shown here with control and displays associated with the counsel, applicants' also envision an alternative embodiment that puts controls and displays of operating parameters and settings on a wireless, hand-held remote control.

Figure 3:
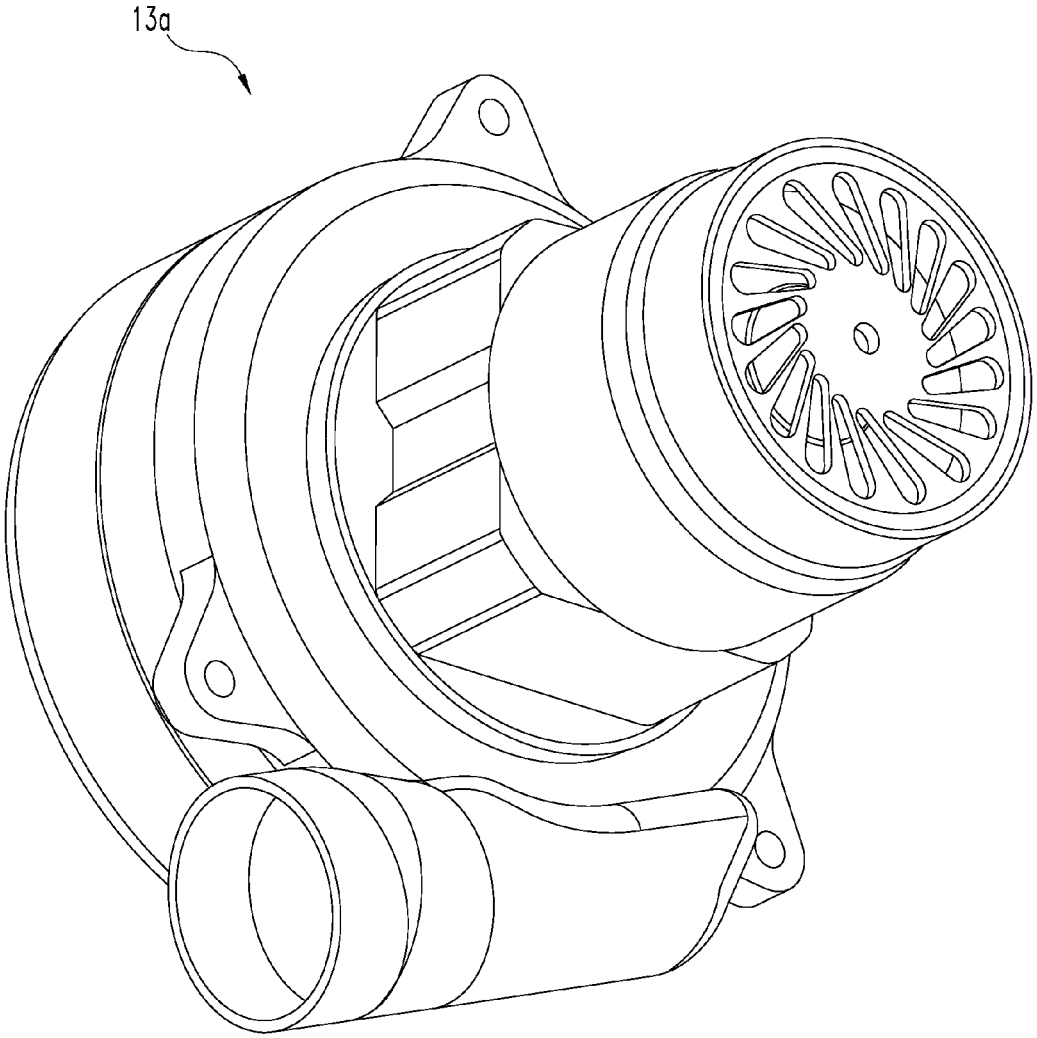
FIG. 3 is a perspective view showing one illustrative blower embodiment of the source of air pressure component of the IPC device of FIG. 1.

Referring now also to FIG. 3, preferred aspects of the design of the source of air pressure 13 will now be described. An important consideration in the design of the air pressure source 13 of IPC device 10 is getting the right pressure at the needed volumes needed to provide rapid, nearly instantaneous, rise to the target (higher) compression pressure inside the inflation cuff 12 without risking the generation of potentially dangerous high air pressures, complicated valving, and pressure regulation such as is associated with air compressors and other types of pneumatic pressure generator devices used in the prior art. It has been found that simple, commercially available blowers such as for example blower 13*a* can provide the desired compression (higher) pressure at the inflatable cuff 12, preferably at a source pressure less than 130% of the higher pressure at the inflatable cuff. The higher pressure desired at the inflatable cuff 12 is preferably in a range of about 50-130 mm Hg. Centrifugal fan type blowers, most preferably tangential blowers such as depicted in FIG. 3, are more favored in certain embodiments in that they can produce air in the desired pressure ranges with a relatively high volume. A larger available volume of airflow substantially decreases bladder inflation time within cuff 12. Using a blower as the source of air pressure 13 provides air generated at a desired pressure that remains continuously on during the sequence of compression/decompression cycles and therefore considerably simplifies the pneumatic controls needed while at the same time providing a much lower pressure generating source that is much safer for the operator/user in a home use environment. The closer the blower's maximum pressure generating capacities are to the needed inflation cuff pressures the less is the risk of overpressure, such as may be due to operator error or equipment failure, and therefore greater safety is provided for the operator and user. These characteristics are determined by many factors—blade type and composition (impeller, turbine, plastic, titanium), clearance tolerance of the impeller, speed of the motor and so on.

Typical commercial blowers come in different sizes, types, and variations. FIG. 3 depicts one illustrative embodiment of a blower 13*a* (with motor), model no. 117478-12 manufactured by Lamb Electric Division of Ametek in Kent, Ohio, that was successfully tested in a prototype version of the IPC device 10. If the IPC device 10 is designed for multiple applications requiring differing compression pressures, different motors speeds such as can be obtained through the use of a dimmer control 40 define the compression pressure attained for each application.

Aspects of the passageway 14 between the blower 13*a* and the inflatable cuff 12 will now be described in detail. The passageway 14, part of which is shown in one preferred form as flexible hose 18 in FIG. 2, preferably provides a continuous direct passageway between the discharge outlet of blower 13*a* and the inlet to inflatable cuff 12, thus serving to minimize pressure drop between the discharge outlet of blower 13*a* and the inlet to cuff 12. In order to produce desired rapid, nearly instantaneous, inflation of the cuff 12 for reasons which will be described later herein, the passageway 14 is designed to have a relatively larger cross sectional area than has been associated with previous IPC devices. Thus, the passageway 14 has a cross sectional area of at least about 1.3 square centimeters between the outlet of blower 13*a* and the inlet to the inflatable cuff 12. In certain more preferred aspect, the cross sectional area of the passageway 14 is at least 2.5 square centimeters between the outlet of blower 13*a* and the inlet to the inflatable cuff 12. In an even more preferred aspect, the cross sectional area is at least about 5 square centimeters between the outlet of blower 13*a* and the inlet to the inflatable cuff 12. In a prototype construction, passageway 14 had a circular cross section greater than 1 inch in diameter through its entire length from blower to cuff inlet, including the portion through vent valve 15. By having such a large diameter, the rate of change of pressure to the interior of the cuff can be very rapid, yet very safe in avoiding the potential of large overpressures with equipment malfunction.

Figure 4A:
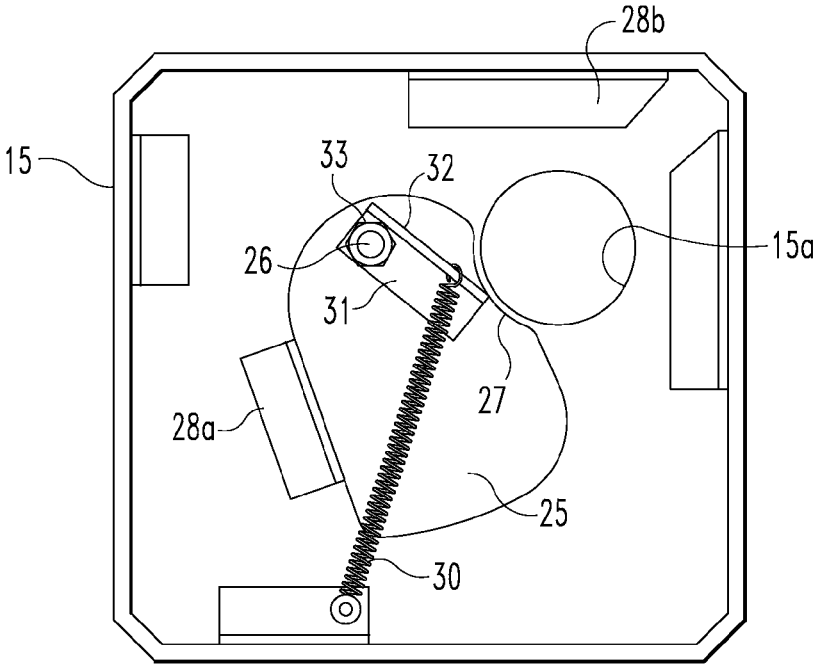
FIGS. 4*a* and 4*b* shows details of one preferred arrangement of the vent valve of the IPC device of FIG. 1 in the respective open and close positions.
Figure 4B:
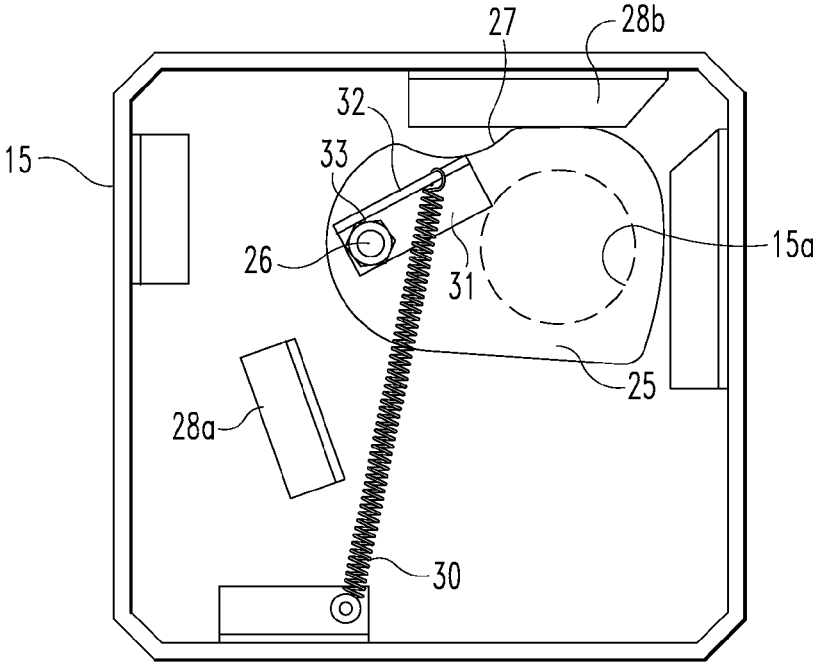

Referring now to FIGS. 4*a* and 4*b*, one illustrative example of the construction of vent valve 15 is shown in detail. It should however be appreciated that the vent valve 15 may be of any known and otherwise suitable construction capable of achieving the IPC control parameters, including but not limited to rise time, duration of compression, duty cycle, etc. described herein. The vent valve 15 is designed and positioned to transition between the lower or no pressure state to substantially achieve the higher pressure state within about 0.1 seconds or less, in order that the vent valve 15 can be opened when a lower or no pressure condition in the inflatable cuff is desired, and can close when the higher pressure is desired. The vent valve 15 is positioned in fluid communication with the passageway 14 so that it opens to vent both the inflatable cuff 12 and the source of air 13 to the atmosphere for the lower or no pressure state, and closes to provide a direct passageway from the source of air 13 to the inflatable cuff 12 for the higher pressure state.

In the example shown in FIGS. 4*a* and 4*b*, the vent valve 15 is a paddle type valve. The paddle 25 pivots horizontally on shaft 26 between open (FIG. 4*a*) and close (FIG. 4*b*) positions over a vent port 15*a*. The cross sectional area of the vent port 15*a* may vary along with the size of the passageway 14, and in some embodiments may be made as large or larger than passageway 14. However, it should also be appreciated that as the diameter of the opening in vent port 15*a* is increased and approaches the size of the turning radius of the paddle 25, the travel angle, and therefore travel distance and actuation time, goes up sharply. Reducing the radius of the paddle 25 reduces the mass of the paddle, which reduces power and decreases actuation time. The vent port 15*a* should therefore be designed with this in mind while optionally keeping a small (lower) leakage pressure at the cuff 12 at a sufficient level to maintain the shape of the cuff 12 close to its inflated, higher pressure contour and thus further reduce the rise time needed to reach the higher pressure level needed for compression, and minimize inadvertent repositioning of the cuff 12. We prefer achieving this goal by having the lower pressure at 2 to 5 mm Hg. The vent valve leakage air pressure, if desired, may also serve to reduce friction between the paddle 25 and the vent port 15*a*. Paddle 25 has a cut out portion 27 that allows for unrestricted airflow when vent valve 15 is open and reduces the paddle travel needed, thus further minimizing actuation times. Paddle 25 rests against one or two rolling-element bearings (not shown) to limit paddle deflection when in the close position. In the embodiment shown in FIGS. 4*a* and 4*b*, the vent port 15*a* has a diameter of approximately 2 inches.

Vent valve 15 has travel stops 28*a* and 28*b* limiting the travel of paddle 18. The stops 28*a* and 28*b* may be cushioned to absorb shock and slow travel. The duration of compression and cycle frequency used for each therapy application is controlled through timing of the movement of the vent valve 15 between its open and close positions. A fault system allows the device to "shutdown" when needed for any detected fault that is chosen. While reference is made to "close" position, it should be understood that it need not be fully closed, as some leakage can facilitate operation or adjust peak pressure. Similarly, reference to "open" position is intended to encompass a substantially open position, with variations possible to adjust the low pressure at the cuff to the preferred 2 to 5 mm Hg. because of the continued supply of air from the source of air to the cuff while in the open position.

Figure 5:
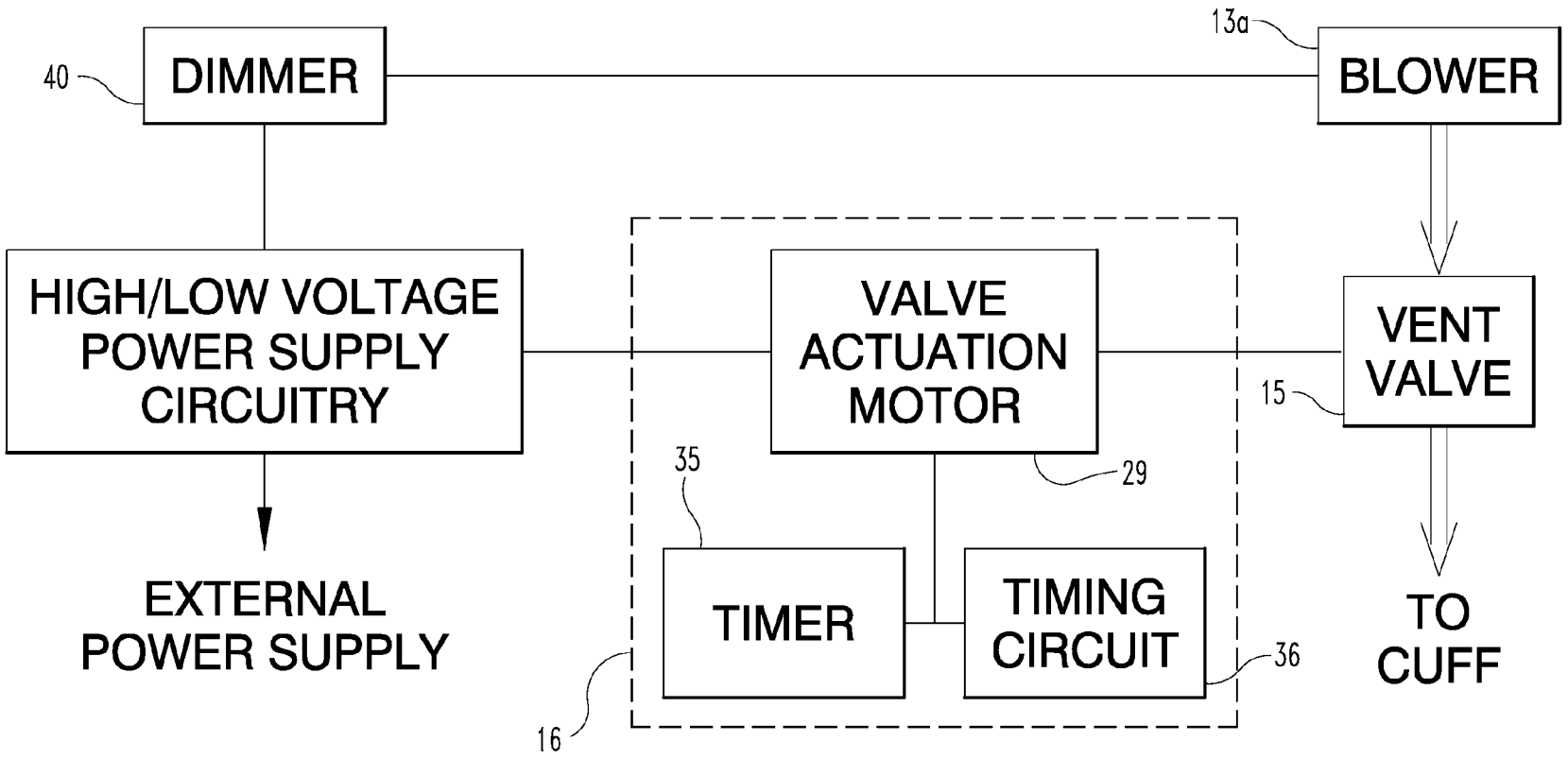
FIG. 5 is a schematic block diagram of the control unit component of the IPC device of FIG. 1.

Reference will now also be made to FIG. 5 in describing the design and operation of the control means 16. The specific design of control means 16 may optionally take many forms so long as it is capable of providing the timing and sequencing of the valve operation within the following control parameters. In this preferred embodiment, control means 16 controls the air pressure delivered to the inflatable cuff 12 by controlling the actuation of vent valve 15 between its open and close positions, applying higher air pressure associated with the close position of vent valve 15 for periods of about 0.35 to 5 seconds, and allowing release of air pressure from the inflation cuff 12 at other times, and repeating such application of higher air pressure about every 2 to 10 seconds. In a further embodiment, the control means 16 is operable to apply the higher air pressure associated with cuff compression for periods of about 0.35 to 3 seconds. By keeping the higher air pressure at the highest level for no more than one second, discomfort of the process is minimized, and in our testing, we generally maintained the highest level pressure for from 0.4 to 0.8 seconds. In one especially preferred aspect, the means to control air pressure applies air pressure for periods of about 0.4 seconds and repeating such application of higher air pressure occurs about every two seconds. In a further aspect, the control means 16 selectively controls the higher pressure depending upon the type of circulatory condition for which IPC therapy is provided.

In the embodiment of vent valve 15 shown in FIGS. 4*a* and 4*b*, the control unit 16 is an electromechanical assembly including an electrically operated valve actuation motor 29 with associated electrical control and timing circuitry, and a mechanically operated return incorporating return spring 30 and lever arm 31. The valve actuation motor 29 actuates counterclockwise pivot movement of paddle 25 on shaft 26 from the valve open position shown in FIG. 4*a* to the valve close position shown in FIG. 4*b*, whereas return spring 30 and lever arm 31 urge the return of the paddle 25 back to the open position shown in FIG. 4*a*. Thus, the actuating motion of motor 29 is preferably one-way only. Return spring leverage can be adjusted by moving the attachment point of spring 30 to different attachment holes 32 located on the lever arm 31. Bolt 33 holds lever arm 31 and paddle 25 to shaft 26. The return spring 30 and lever arm 31 are set so that maximum spring counter force occurs when the paddle 25 is nearly closed so that the velocity of the paddle 25 slows greatly at the last part of travel but still has sufficient remaining energy to close reliably. Motor 29 is actuated by a timer 35 having suitable associated timing control circuitry 36 which, for example, provides the duty cycle pulse.

Figure 6:
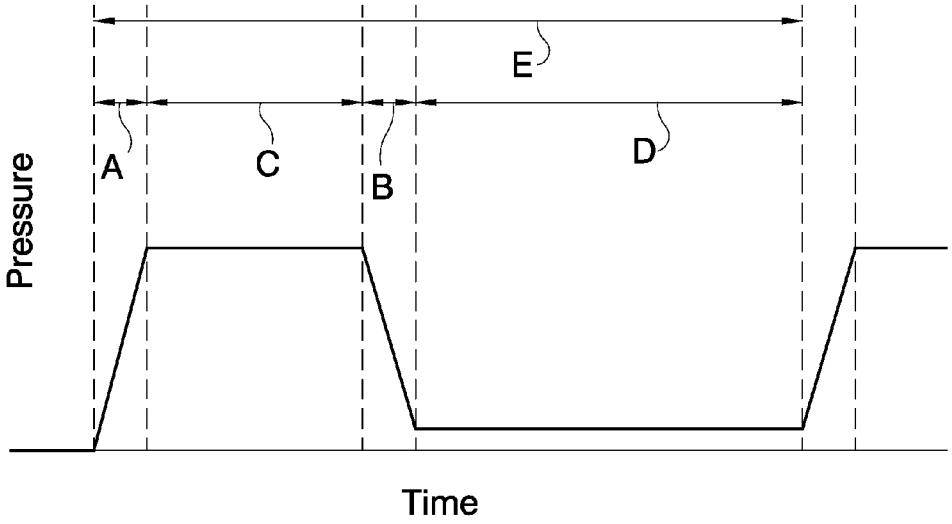
FIG. 6 is graph illustrating one example of the relationship between rise time, frequency and duration of compressions achieved by the various embodiments of the intermittent pneumatic compression device.

FIG. 6 graphically designates periods for rise time, high pressure, fall time, and low pressure as they vary with time, and the total cycle period for compressions achieved by the various embodiments of the intermittent pneumatic compression device 10. For purposes of illustration only, the graph depicts the various segments of the compression cycles not drawn to actual scale and as linear even though actual pressures may have some non-linearity. As seen in FIG. 6, the letter "A" indicates the rise time during which the pressure within the inflation cuff 12 rises from the lower or no pressure (relative to standard atmospheric pressure) state to the higher pressure state associated with the target compression pressure. The rise time "A" of the IPC device 10 is designed to be achieved within 0.1 seconds or less. The letter "B" refers to the fall time during which the inflation cuff 12 returns from the higher pressure to the lower or no pressure state. The fall time "B" may or may not be as short as the rise time "A" and most likely would be somewhat longer. The letter "C" shows the duration of time cuff 12 exhibits the higher pressure state associated with maximum compression. The letter "D" indicates the period of time during which the inflation cuff 12 is at the lower (preferably) or no pressure state between compression cycles. The letter "E" indicates the total length of time between compressions.

The IPC device 10 also optionally includes a dimmer attenuation feature. The dimmer 40 is of conventional design suitable for use with a motor. The dimmer operates to vary the blower 13*a* output pressure and consequently volume. To make it work with a variety of blower types and still have a discrete range of function, dimmer 40 is optionally provided two basic ranges that are set by a switch. The range output values are set based on needs and safety to allow desired pressure levels and for example may be changed by changing resistor components in the dimmer circuitry. The switch may be set for example in a first range such as for a two stage blower in order to produce from 40 to 125 mm Hg with the output blocked at the valve. In a second pressure range such as may be associated with a larger one stage blower, the range setting may for example produce from 50 mm of Hg to 90 mm of Hg with the blower output blocked at the valve. A further option is to simply plug the blower 13*a* directly into an external variable power source or add a further switch if full power without dimmer attenuation is desired.

The protocol for proper use of the IPC device 10 to treat circulatory problems such as for example PAD, lymphedema, and venous insufficiency may vary depending upon the condition being treated, severity, and patient specific situations such as pain tolerance, etc. The device has been tested successfully for treatment of a PAD induced heel ulcer implementing a 60 min./day treatment protocol, delivering positive results in a treatment period spanning four months.

To understand various options for choosing an appropriate blower, the following table lists results obtained using various prototype setups of the IPC device 10 for various blowers, at full speed, without use of speed controls. The highest pressures shown were experimental and not used in cuffs on patients, as lower pressures are quite suitable, less painful, and more efficient. In general, the desired pressure for use with a cuff solely for a digit, such as a finger or toe, is higher than the pressure used for a cuff for other parts of the body:

| | Compression/Non-compression (seconds) | | |
|---|---|---|---|
| | .35/1.4 | .45/1.4 | .75/2.25 |
| Cycles/minute | 34 | 32 | 20 |
| Small Single Stage Blower (Min Pressure <1 mm) | | | 55 mm of HG |
| Large Single Stage Blower (Min Pressure 4 mm) | 90 mm | 95 mm | 100 mm of HG |
| Large 2 Stage Blower (High Pressure Limit disconnected)(Min Pressure 2 mm) | >200 mm | >200 mm | >200 mm of HG |

While less desirable, one could consider alternate sources of pressure, such as a higher pressure compressors with air pressure regulators, or large reservoirs of compressed air to achieve the working pressures that are desired.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An intermittent pneumatic compression device for facilitating fluid circulation in a body by alternating between a higher pressure and a lower or no pressure in an associated inflatable cuff, comprising:

an inflatable cuff for an extremity;

a blower providing air at a pressure less than 130% of the higher pressure at the inflatable cuff, wherein the blower is continuously on during the alternating cycles of pressure;

a passageway that remains continuously open during the alternating, said passageway extending between said blower and said inflatable cuff; and a vent valve coupled to said passageway, said vent valve having a rotating paddle that when closed has one side adjacent said passageway and an opposite side adjacent a path to the atmosphere;

whereby the vent valve can be opened when a lower or no pressure condition in the inflatable cuff is desired, and can close when the higher pressure is desired.

2. The intermittent pneumatic compression device of claim 1 wherein said blower is a fan.

3. The intermittent pneumatic compression device of claim 2 wherein said blower is a centrifugal fan.

4. The intermittent pneumatic compression device of claim 1 wherein said inflatable cuff is formed to cover at least the foot of the wearer and has minor portions that are see-through permitting visibility of the wearer's toes and heel.

5. An intermittent pneumatic compression device for facilitating fluid circulation in a body by alternating between a higher pressure and a lower or no pressure in an associated inflatable cuff, comprising:

an inflatable cuff for an extremity;

a source of air at a pressure less than 130% of the higher pressure at the inflatable cuff, wherein the source of air is continuously on during the alternating cycles of pressure;

a passageway that remains continuously open during the alternating, said passageway being between said source and said inflatable cuff in which said passageway has a cross sectional area of at least 1.3 square centimeters between said source and said inflatable cuff; and a vent valve having a rotating paddle that when closed has one side adjacent said passageway and an opposite side adjacent a path to the atmosphere to provide for the alternating between a higher pressure and a lower or no pressure, whereby the vent valve can be opened when a lower or no pressure condition in the inflatable cuff is desired, and can close when the higher pressure is desired.

6. The intermittent pneumatic compression device of claim 5 in which the cross sectional area is at least 2.5 square centimeters between said source and said inflatable cuff.

7. The intermittent pneumatic compression device of claim 6 in which the cross sectional area is at least 5 square centimeters between said source and said inflatable cuff.

8. An intermittent pneumatic compression device for facilitating fluid circulation in a body by alternating between a 40 to 125 mm higher pressure and a 5 mm or less lower or no pressure in an associated inflatable cuff, comprising:

an inflatable cuff for an extremity;

a pressure source for providing the higher pressure at the inflatable cuff, wherein the pressure source is continuously on during cycles of alternating pressures;

a connecting pathway coupled between said pressure source and said inflatable cuff, wherein the connecting pathway remains continuously open during the alternating cycles of pressure;

a valve; and said connecting pathway providing a sufficiently large cross sectional area relative to the volume of said inflatable cuff, the capacity of said pressure source and a sufficiently rapid valve speed to transition between the lower or no pressure state to achieve the higher pressure state within 0.1 second or less.

9. The intermittent pneumatic compression device of claim 8 in which said pressure source provides air pressure at less than 130% of the higher pressure at the inflatable cuff.

10. The intermittent pneumatic compression device of claim 8 in which said valve has a cross sectional area for the path from the source of pressure to the body that is at least 1.3 square centimeters.

11. The intermittent pneumatic compression device of claim 10 in which said valve's cross sectional area is at least 2.5 square centimeters between said source and said inflatable cuff.

12. The intermittent pneumatic compression device of claim 11 in which the valve's cross sectional area is at least 5 square centimeters between said source and said inflatable cuff.

13. The intermittent pneumatic compression device of claim 8 with frequent, small duty cycles additionally comprising:

means to control air pressure to said cuff by applying air pressure for periods of 0.35 to 5 seconds, and allowing release of air pressure from said cuff at other times, and repeating such application of air pressure every two to 10 seconds.

14. The intermittent pneumatic compression device of claim 13 in which said means to control air pressure applies air pressure for periods of 0.35 to 3 seconds.

15. The intermittent pneumatic compression device of claim 14 in which said means to control air pressure applies air pressure for periods of only about 0.4 seconds.

16. The intermittent pneumatic compression device of claim 15 in which said repeating is about every two seconds.

17. The intermittent pneumatic compression device of claim 8 in which said higher pressure is at least 50 mm Hg.

18. The intermittent pneumatic compression device of claim 17 in which said means to control air pressure applies air selectively controls said higher pressure depending upon the type of circulatory condition given therapy.

19. An intermittent pneumatic compression device for facilitating fluid circulation in a body by alternating between a higher pressure and a lower or no pressure in an associated inflatable cuff, comprising:

an inflatable cuff for an extremity;

a source of air at a pressure that remains continuously on during the sequence of cycles;

a continuous passageway that remains continuously open during the alternating, said passageway extending between said source and said inflatable cuff; and a vent valve coupled to said passageway that includes a rotating paddle that opens to vent both said inflatable cuff and said source of air to the atmosphere for the lower or no pressure state, and closes to provide a direct passageway from said source of air to said inflatable cuff for the higher pressure state.

20. The intermittent pneumatic compression device of claim 19 wherein said source of air is a blower.

21. The intermittent pneumatic compression device of claim 20 wherein said blower is a centrifugal fan.

22. The intermittent pneumatic compression device of claim 19 in which said continuous passageway is greater than 30 cm between said vent valve and said cuff.

23. The intermittent pneumatic compression device of claim 19 in which there is no pressure regulator device near said cuff and the passageway during the last 30 cm is free of restrictions.

24. An intermittent pneumatic compression device for facilitating fluid circulation in a body by alternating between a higher pressure and a lower or no pressure in an associated inflatable cuff, comprising:

an inflatable cuff;

a console containing a. a source of pressure supplying air to a plenum within the console, wherein the source of pressure supplying air is continuously on during the alternating cycles of pressure, and b. a valve member that opens and closes a hole in the console between the plenum and the atmosphere; and a passageway at least 30 cm long coupled between said cuff and said plenum in said console, with said passageway being free of restrictions so that the console plenum and inflatable cuff remain continuously connected and remains continuously open during said alternating.

* * * * *